US010094198B2

(12) United States Patent
Nguyen et al.

(10) Patent No.: US 10,094,198 B2
(45) Date of Patent: Oct. 9, 2018

(54) BIG GAP ELEMENT SEALING SYSTEM

(71) Applicant: Weatherford Technology Holdings, LLC, Houston, TX (US)

(72) Inventors: Thom T. Nguyen, Spring, TX (US); Rocky A. Turley, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 780 days.

(21) Appl. No.: 14/229,245

(22) Filed: Mar. 28, 2014

(65) Prior Publication Data

US 2014/0290946 A1 Oct. 2, 2014

Related U.S. Application Data

(60) Provisional application No. 61/806,506, filed on Mar. 29, 2013.

(51) Int. Cl.

| | |
|---|---|
| ***E21B 33/16*** | (2006.01) |
| ***E21B 33/12*** | (2006.01) |
| ***E21B 43/10*** | (2006.01) |

(52) U.S. Cl.

CPC ..... *E21B 33/16* (2013.01); *E21B 33/1204* (2013.01); *E21B 33/1208* (2013.01); *E21B 33/1216* (2013.01); *E21B 43/10* (2013.01)

(58) Field of Classification Search

CPC .. E21B 33/1208; E21B 33/1216; E21B 33/16; E21B 33/1204; E21B 43/10

See application file for complete search history.

(56) References Cited

U.S. PATENT DOCUMENTS

| | | | |
|---|---|---|---|
| 3,460,617 | A | 8/1969 | Brown et al. |
| 3,987,854 | A | 10/1976 | Callihan et al. |
| 4,059,150 | A | 11/1977 | Manderscheid |
| 4,457,369 | A | 7/1984 | Henderson |
| 4,765,404 | A | 8/1988 | Bailey et al. |

(Continued)

FOREIGN PATENT DOCUMENTS

WO 2005/121498 A1 12/2005

OTHER PUBLICATIONS

Canadian Office Action dated Aug. 8, 2016, for Canadian Patent Application No. 2,904,531.

(Continued)

*Primary Examiner* — Waseem Moorad
*Assistant Examiner* — Christopher J Sebesta
(74) *Attorney, Agent, or Firm* — Patterson + Sheridan, LLP

(57) ABSTRACT

A sealing system includes a packing element having a groove in a surface thereof. The packing element is adapted to form a double hump configuration upon compression. The sealing system may include a first ring member disposed a first end of the packing element, a second ring member is disposed at a second end of the packing element, a first seal ring is disposed laterally outward of the first ring member, and a second seal ring is disposed laterally outward of the second ring member. A first inner back-up ring is disposed laterally outward of the first seal ring. The first inner back-up ring includes slots. A first outer back-up ring is disposed adjacent the first inner back-up ring and includes slots, wherein that slots in the first outer back-up ring are offset from the slots in the first inner back-up ring.

25 Claims, 7 Drawing Sheets

(56) References Cited

U.S. PATENT DOCUMENTS

| | | | | |
|---|---|---|---|---|
| 5,775,429 | A * | 7/1998 | Arizmendi | E21B 33/128 166/196 |
| 5,857,520 | A | 1/1999 | Mullen et al. | |
| 6,167,963 | B1 | 1/2001 | McMahan et al. | |
| 6,343,791 | B1 * | 2/2002 | Anyan | E21B 33/128 277/337 |
| 7,373,973 | B2 | 5/2008 | Smith et al. | |
| 7,424,909 | B2 | 9/2008 | Roberts et al. | |
| 7,661,471 | B2 | 2/2010 | Murray et al. | |
| 7,708,080 | B2 | 5/2010 | Conaway et al. | |
| 7,810,558 | B2 | 10/2010 | Shkurti et al. | |
| 7,896,085 | B2 | 3/2011 | Nutley et al. | |
| 8,047,280 | B2 | 11/2011 | Tran et al. | |
| 8,141,626 | B2 | 3/2012 | Freyer | |
| 8,393,388 | B2 | 3/2013 | Bishop et al. | |
| 2006/0289173 | A1 * | 12/2006 | Conaway | E21B 33/1216 166/387 |
| 2009/0065192 | A1 * | 3/2009 | Lucas | E21B 33/128 166/119 |
| 2009/0255690 | A1 * | 10/2009 | Conner | E21B 33/1216 166/387 |
| 2012/0012304 | A1 * | 1/2012 | Brennan, III | E21B 49/10 166/118 |
| 2012/0133098 | A1 * | 5/2012 | Farquhar | E21B 33/128 277/314 |
| 2012/0279705 | A1 * | 11/2012 | Moffitt | E21B 33/14 166/285 |
| 2013/0284436 | A1 * | 10/2013 | Besijn | E21B 33/12 166/277 |

OTHER PUBLICATIONS

PCT Search Report and Written Opinion for International Application No. PCT/US2014/032236 dated Feb. 20, 2015.

Canadian Office Action dated Apr. 11, 2017, for Canadian Patent Application No. 2,904,531.

* cited by examiner

BIG GAP ELEMENT SEALING SYSTEM

BACKGROUND OF THE DISCLOSURE

1. Field of the Disclosure

Embodiments of this disclosure generally relate to a wellbore tool, and more particularly, to an element sealing system for a wellbore tool.

2. Description of the Related Art

A liner-top packer is run as an integral part of the liner hanger assembly to provide a reliable, high-integrity seal that isolates the gap between an outer diameter of the liner and an inner diameter of a surrounding casing. The liner-top packer is configured to provide pressure integrity, isolate the cement, and prevent gas migration or flow while the cement sets.

The liner-top packer is normally set by setting down weight on the polished bore receptacle (PBR) with a packer actuator after the running tool is released. The weight is transferred to the liner-top packer to set a packing element in a conventional element sealing system.

With the conventional element sealing system, the typical pre-set cross-sectional thickness of the packing element is greater than the cross-sectional thickness of the gap between the outer diameter of the liner, and the inner diameter of the surrounding casing. Thus, the conventional element sealing system in the liner-top packer is able to create a seal with the surrounding casing. However, when the cross-sectional thickness of the gap between the outer diameter of the liner and the inner diameter of the surrounding casing is larger than the pre-set cross-sectional thickness of the packing element, the conventional element sealing system is unable to create a seal with the surrounding casing.

Therefore, there is a need for an element sealing system that is configured to create a seal with the surrounding casing when the gap between the outer diameter of the liner and the inner diameter of the surrounding casing is greater than the thickness of the packing element.

SUMMARY OF THE DISCLOSURE

In one embodiment of this disclosure, an element sealing system for a wellbore tool is provided.

In one aspect of the disclosure, a sealing system for use in a downhole tool comprises a packing element including a groove in a surface thereof, the packing element adapted to form a double hump configuration upon compression; a first ring member disposed a first end of the packing element; a second ring member disposed at a second end of the packing element; a first seal ring disposed laterally outward of the first ring member; a second seal ring disposed laterally outward of the second ring member; a first inner back-up ring disposed laterally outward of the first seal ring, the first inner back-up ring having slots; and a first outer back-up ring having slots, the first outer back-up ring disposed adjacent the first inner back-up ring, wherein that slots in the first outer back-up ring are offset from the slots in the first inner back-up ring.

In another aspect, a method of hanging a liner string from a tubular string cemented in a wellbore comprises running the liner string into a wellbore using a workstring having a deployment assembly, wherein the deployment assembly comprises a setting tool, a running tool, a catcher, and a plug release system: setting the liner hanger against the tubular string by pumping a setting plug to the catcher; after setting the hanger, releasing the running tool from the mandrel; after releasing the running tool, pumping cement slurry through the workstring followed by a release plug, wherein the release plug engages a wiper plug of the plug release system and drives the cement slurry through the liner string and into an annulus formed between the liner string and the wellbore; and raising the deployment assembly and setting weight on the polished bore receptacle using the setting tool, thereby: radially expanding the packing element and sealing a gap formed between the sealing system and the tubular string, wherein radially expanding the packing element results in the packing element forming a double hump configuration, and radially expanding the back-up rings into contact with the tubular string. The liner string includes a mandrel having a profile formed in an inner surface thereof for releasable connection to a running tool; the sealing system of claim 6 disposed along the mandrel; a liner hanger disposed along the mandrel; and a polished bore receptacle connected to the first cone member.

In a further aspect, a sealing system for use in a downhole tool is provided. The downhole tool being disposed in a casing such that a gap is formed between the downhole tool and the casing. The sealing system comprises a packing element with a first end and a second end, the packing element having a pre-set cross-sectional thickness that is less than a cross-sectional thickness of the gap formed between the downhole tool and the casing; a first ring member disposed a first end of the packing element; a second ring member disposed at a second end of the packing element; a first seal ring disposed laterally outward of the first ring member; a second seal ring disposed laterally outward of the second ring member; a first inner back-up ring disposed laterally outward of the first seal ring; a first outer back-up ring disposed adjacent the first inner back-up ring; a second inner back-up ring disposed laterally outward of the second seal ring; and a second outer back-up ring disposed adjacent the second inner back-up ring.

In another aspect, a method of setting a packer, comprises positioning a mandrel having a sealing system thereon within a wellbore, the sealing system comprising a packing element having a groove formed therein, the groove adjacent the mandrel; a first inner back-up ring disposed at a first end of the packing element, the first inner back-up ring having slots; and a first outer back-up ring having slots, the first outer back-up ring disposed adjacent the first inner back-up ring, wherein that slots in the first outer back-up ring are offset from the slots in the first inner back-up ring; and setting the packing element, wherein setting the packing element includes forming a double hump configuration with the packing element.

In another embodiment, a method of setting a packer in a wellbore includes positioning a mandrel having a sealing element within the wellbore; and setting the packing element such that the packing element forms a double hump configuration.

In one or more of the embodiments described herein, the sealing element is positioned at a distance from the wellbore bore that is more than a thickness of the sealing element.

In one or more of the embodiments described herein, a ratio of the distance between the sealing element and the wellbore wall to the thickness of the sealing element is from about 1.05 to about 2.0.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of this disclosure generally relate to an element sealing system for a wellbore tool. The element sealing system will be described herein in relation to a liner-top packer. It is to be understood, however, that the element sealing system may also be used with other downhole tools without departing from principles of the present disclosure. Further, the element sealing system may be used in a wellbore tool that is disposed within a cased wellbore or within an open-hole wellbore. To better understand the element sealing system of the present disclosure and the methods of use thereof, reference is hereafter made to the accompanying drawings.

In one embodiment, a rubber packer seal assembly is provided to achieve a positive high temperature, high pressure seal in an annulus area where the annular sealing gap is greater than the available element thickness. This rubber packer seal assembly design includes multiple metal back-up rings, which deform under load (mechanical load and/or pressure load) to form a chamber that encloses a packing element, such as a rubber element, under load. The chamber formed by the metal back-up rings also prevents the packing element from extrusion and thus allows the packing element to achieve a consistent seal against an internal surface of a casing.

Figure 1A:
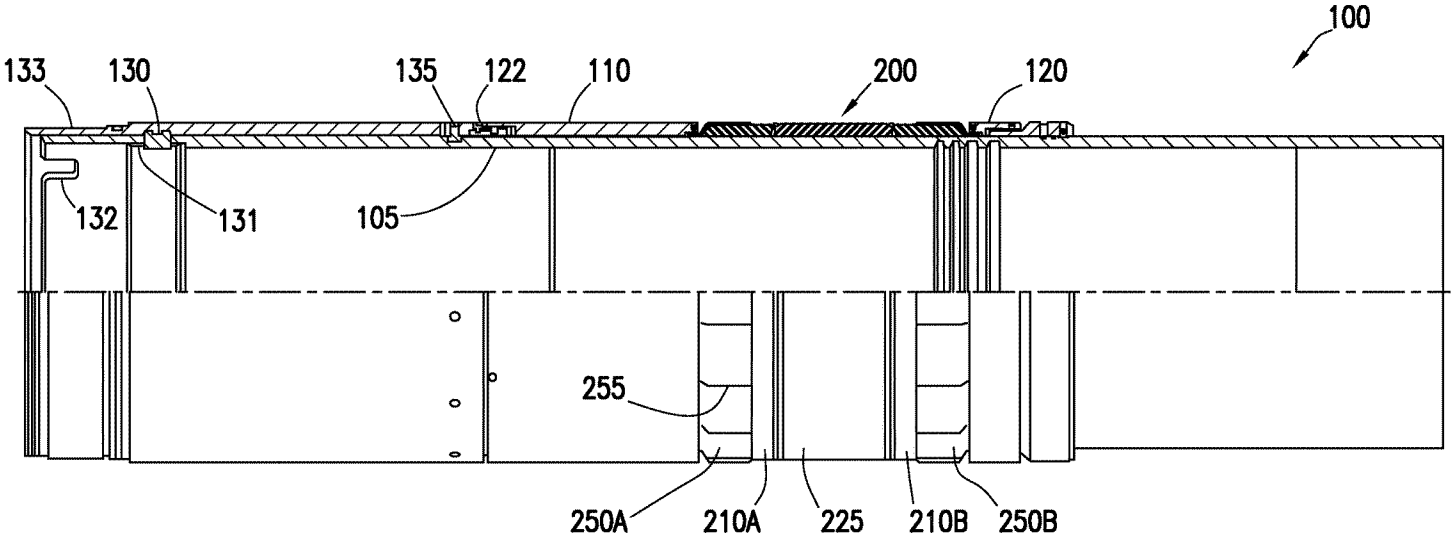
FIG. 1A illustrates a liner-top packer, according to an embodiment of this disclosure.

FIG. 1A illustrates a liner-top packer 100, according to one embodiment of this disclosure. The liner-top packer 100 includes an element sealing system 200 that is configured to create a seal that isolates a gap between an outer diameter of the liner-top packer 100 and an inner diameter of a surrounding casing 10 (shown in FIG. 2). Generally, the liner-top packer 100 is configured to provide pressure integrity, isolate cement, prevent gas migration or flow while the cement sets.

Figure 1B:
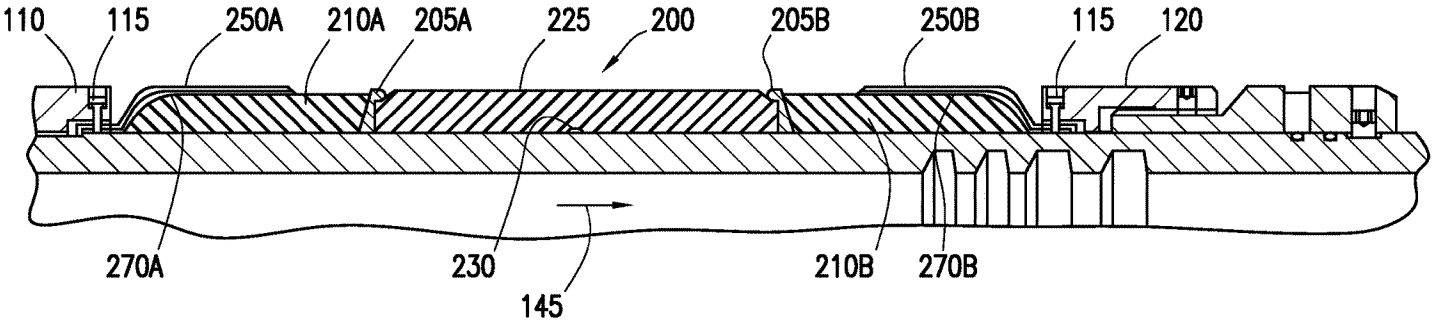
FIG. 1B illustrates an element sealing system in the liner-top packer.

FIG. 1B illustrates a view of the element sealing system 200 in the liner-top packer 100. As shown, the element sealing system 200 includes an annular packing element 225 and seal rings 210A, 210B disposed at opposite ends thereof. The packing element 225 is separated from the seal rings 210A, 210B by ring members 205A, 205B disposed therebetween. The packing element 225 includes a groove 230 on an inner surface thereof adjacent a tubular mandrel 105. The groove 230 facilitates flexing of the packing element 225 at the groove 230 location during a setting operation for the liner-top packer 100. In one embodiment, the packing element 225 has a lower durometer than the seal rings 210A, 210B, such as the packing element 225 being made from an elastomer or elastomeric copolymer and the seal rings 210A, 210B being made from an engineering polymer, metal, or alloy. In one example, the packing element may have a durometer of about 75, while the seal rings 210A, 210B may have a durometer of about 85.

As shown, a first outer back-up ring 250A and a first inner back-up ring 270A are disposed at a first laterally outward end of the seal ring 210A, while a second outer back-up ring 250B and a second inner back-up ring 270B are disposed at a second laterally outward end of the seal ring 201B. The second laterally outward end may be opposite the first laterally outward end, as shown. The outer back-up rings 250A, 250B each include slots 255 (FIGS. 7A-70) formed therein, and the inner back-up rings 270A, 270B each include slots 275 (FIGS. 8A-8C) formed therein. The slots 255, 275 are positioned parallel to one another and are formed concentrically around the outer back-up rings 250A,B and inner back-up rings 270A,B, respectively. The slots 255, 275 facilitate expansion of the outer back-up rings 250A,B and inner back-up rings 270A,B to contact the casing 10, thus forming a containment region for the packing element 225, as explained below.

During assembly of the element sealing system 200, the outer back-up rings 250A, 250B are positioned on and over the inner back-up rings 270A, 270B such that the slots 255 of the outer back-up rings 250A, 250B are offset from the slots 275 of the inner back-up rings 270A, 270B. The offset of the slots 255, 275 substantially prevents the extrusion of the seal rings 210A, 210B through the slots 255, 275 when the element sealing system 200 is set. Additionally, the slots 255, 275 in the back-up rings 250A,B and 270A,B allow the back-up rings 250A,B and 270A,B to expand further radially outward as compared to back-up rings without slots. As shown in FIG. 1B, laterally outward ends of the outer back-up rings 250A, 250B and the inner back-up rings 270A, 270B are respectively attached to a first cone member 110 and a second cone member 120 of the liner-top packer 100 by fasteners 115, such as socket head cap screws. The fasteners 115 are configured to prevent rotational movement of the back-up rings 250A,B and 270A,B relative to each other after assembly. In another embodiment, only one back-up ring 250A,B and 270A,B has slots. In yet another embodiment, the back-up rings 250A,B and 270A,B may have a different number of slots.

As shown in FIGS. 1A-1B, the element sealing system 200 is disposed between the first cone member 110 and the second cone member 120 of the liner-top packer 100. As set forth herein, the first cone member 110 moves along a mandrel 105 of the liner-top packer 100 in the direction of the arrow 145 to actuate the element sealing system 200 during the setting operation. Optionally, the second cone member 120 may move in a direction opposite the first cone member 110, or the second cone member 120 may be fixed to resist force applied first cone member 110, thereby facilitate expansion of the packing element 225, the seal rings 210A,B, and the rings 250A,B and 270A,B. The liner-top packer 100 includes a locking mechanism 122, which allows the first cone member 110 to travel in one direction and prevents travel in the opposite direction. The locking mechanism 122 may be a ratchet ring disposed on a ratchet surface of the mandrel 105.

Figure 2:
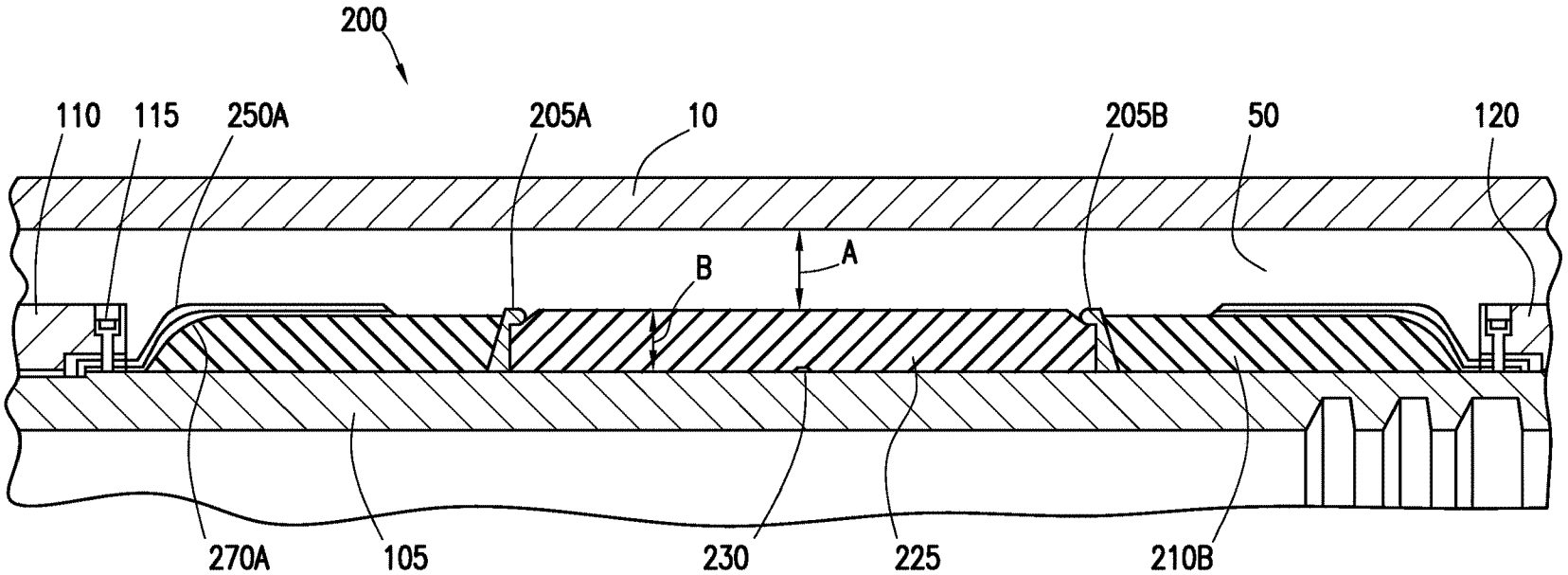
FIG. 2 illustrates the element sealing system in a casing.
Figure 6:
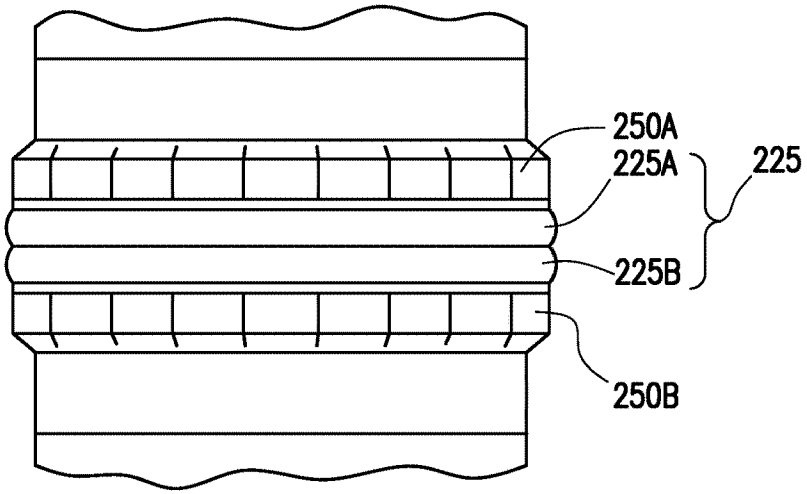
FIG. 6 illustrates the element sealing system after expansion of a packing element.

FIG. 2 illustrates the element sealing system 200 positioned within a casing 10. A gap 50 is formed between an outer diameter of the element sealing system 200 and an inner diameter of the casing 10. The gap 50 has a cross-sectional thickness "A" and the packing element 225 has a pre-set cross-sectional thickness "B." The cross-sectional thickness A may be greater than the cross-sectional thickness B. In one embodiment, the cross-sectional thickness A is about 0.834 inches and the pre-set cross-sectional thickness B is about 0.651 inches. In this embodiment, the ratio of thickness A to thickness B is 1.28. In other embodiments, the ratio of thickness A to thickness B may be in the range of 1.05 to 1.50. In another embodiment, the ratio of thickness A to thickness B may be about 1.05 to about 2.0, such as about 1.1 to about 1.4. With respect to conventional sealing systems, a conventional element sealing system is unable to create a seal with the surrounding casing when the cross-sectional thickness A is greater than the cross-sectional thickness B. In contrast, however, the element sealing system 200 is configured to create a seal with the casing 10 when the cross-sectional thickness A is greater than the cross-sectional thickness B. In one example, when the ratio of thickness A to thickness B is greater than about 1.05, the packing element 225 is adapted to form a "double hump" or multiple protrusion configuration upon compression, as illustrated in FIG. 6. The element sealing system 200 may also be used to create a seal with the casing 10 when the cross-sectional thickness A is equal to or less than the cross-sectional thickness B.

The ring members 205A,B include laterally outward surfaces adjacent the seal rings 210A,B. The laterally outward surfaces are formed at an angle relative to perpendicular to mandrel 105, for example, about 5 degrees to about 20 degrees, such as about 10 degrees to about 15 degrees or about 8 degrees to about 15 degrees. One or more of the laterally outward angled surfaces may also facilitate the formation of a double humped formation of the packing element 225 during compression (shown in FIG. 6).

Figure 3:
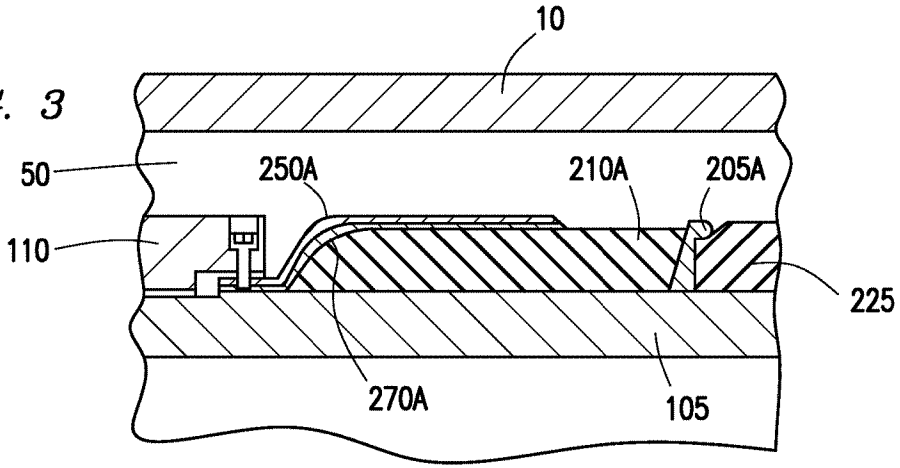
FIG. 3 is an enlargement of a portion of FIG. 2.

FIG. 3 is an enlargement of a portion of FIG. 2. The element sealing system 200 is illustrated prior to setting. The length of the back-up rings 250A, 270A may be different. As shown, the length of the back-up ring 250A is less than the length of the back-up ring 270A, and thus the back-up ring 270A extends beyond the back-up ring 250A. The inner back-up ring 270A may be disposed on in and contact with the seal ring 210A, while the outer back-ring 250A may be disposed on and in contact with the inner back-up ring 270A. The seal ring 210A, the inner back-up ring 270A, and the outer back-up ring 250A may include similarly-contoured mating surfaces. Likewise, the seal ring 210B, the inner back-up ring 270B, and the outer back-up ring 250B may also include similarly-contoured mating surfaces.

Figure 4B:
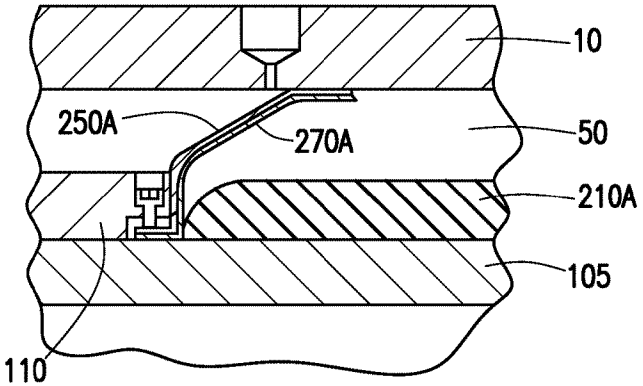
FIG. 4B illustrates an inner backup ring of the element sealing system in an expanded position.
Figure 4A:
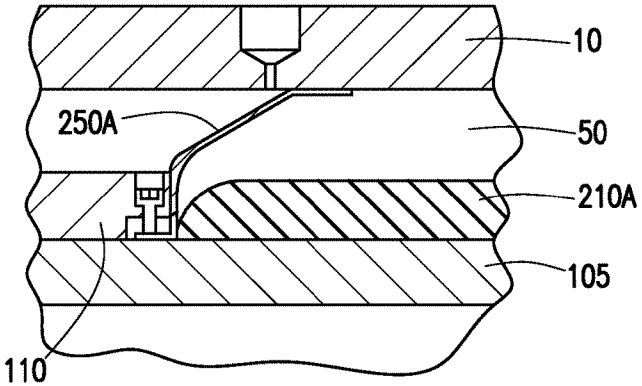
FIG. 4A illustrates an outer backup ring of the element sealing system in an expanded position.

FIG. 4A illustrates the outer backup ring 250A of the element sealing system 200 in an expanded position. The inner back-up ring 270A is not shown for clarity purposes. During the setting operation, the first cone 110 is actuated along the mandrel 105 toward the second cone 120. The movement of the cone 110 compresses the element sealing system 200 between the cones 110, 120, which cause the packer element 225 and the seal rings 210A to expand radially outward. As the seal ring 210A expands radially outward, an end of the back-up ring 250A is forced radially outward and into contact with the casing 10. The end of the back-up ring 250A contacts the inner diameter of the casing 10 to form an anti-extrusion volume for the seal rings 210A. A portion of the back-up ring 250A may bend as the end contacts the inner diameter of the casing 10. The end of the back-up ring 250A is configured to contact the inner diameter of the casing 10 before the seal ring 210A contacts the inner diameter of the casing 10 due to compressive forces applied by cones 110, 120. While not shown, it is to be understood the outer back-up ring 250B operates similarly to the outer back-up ring 250A.

FIG. 4B illustrates the inner back-up ring 270A and outer back-up ring 250A of the element sealing system 200 in an expanded position. In a similar manner to the outer backup ring 250A, an end of the inner backup ring 270A expands radially outward as the seal ring 210 expands radially outward. An unsecured end of the back-up ring 270A contacts the inner diameter of the casing 10 to form an anti-extrusion volume for the seal rings 210A. A portion of the back-up ring 270A may bend as the end contacts the inner diameter of the casing 10. While not shown, it is to be understood the inner back-up ring 270B operates similarly to the inner back-up ring 270A. In one embodiment, the inner back-up rings 270A,B may expand outward simultaneously within the outer back-up rings 250A,B. In another embodiment, inner back-up rings 270A,B may expand outward subsequent to the outer back-up rings 250A,B.

Additionally, the use of variable lengths of back-up rings 250A, 270A, particularly the extra length of the inner back-up rings 270A,B, may be used to facilitate contact of unsecured ends of each back-up ring 250A,B and 270A,B with the inner diameter of the casing 10 in formation of a containment region. Thus, in operation, the seal rings 210A,B and the packing element 225 can expand outward towards the inner diameter of the casing 10, creating a seal that is completely contained and supported by the back-up rings 250A,B and 270A,B.

Figure 5:
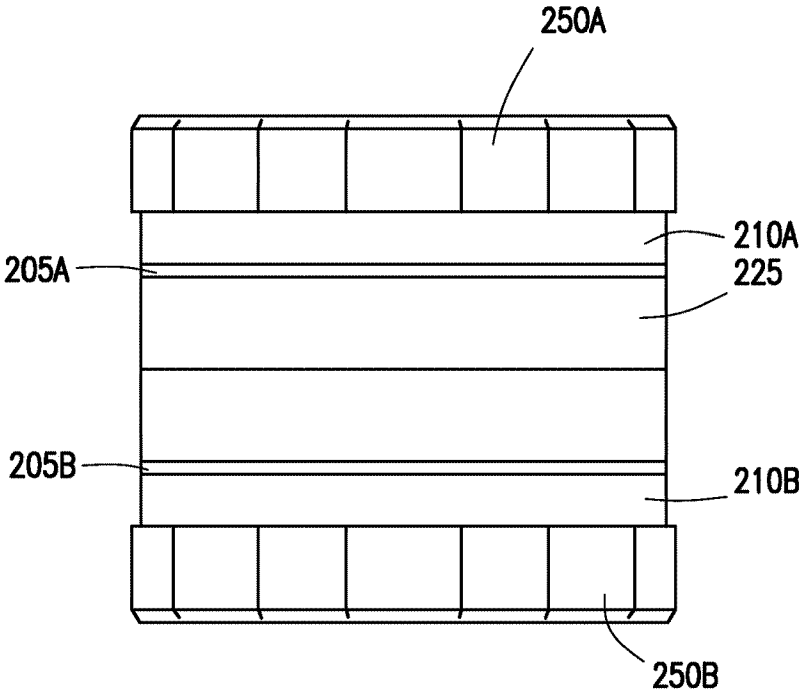
FIG. 5 illustrates the element sealing system prior to expansion of a packing element.

FIG. 5 illustrates the element sealing system 200 prior to expansion of the packing element 225. FIG. 6 illustrates the element sealing system 200 after expansion of the packing element 225. In comparing FIGS. 5 and 6, it can be seen that the axial length of the element sealing system 200 is reduced due to compressive force applied by the first cone member 110 during setting, and consequentially the radially-outward expansion, of the packing element 225. In one embodiment, the axial length of the element sealing system 200 in a pre-set position (FIG. 5) is about 14 inches and the axial length of the element sealing system 200 in a post-set position (FIG. 6) is about 6.875 inches, and thus, setting of the element sealing system 200 can reduce the axial length thereof by about half or more. As also shown in FIG. 6, the packing element 225 in the post-set position has two packing element sections 225A, 225B. The packing element sections 225A, 225B (e.g., a double hump configuration in the compressed state) may be formed during expansion of the packing element 225 due to the presence of the groove 230 formed in the packing element 225 when a ratio of thickness A to thickness B (shown in FIG. 2) is about 1.05 or greater.

Figure 7C:
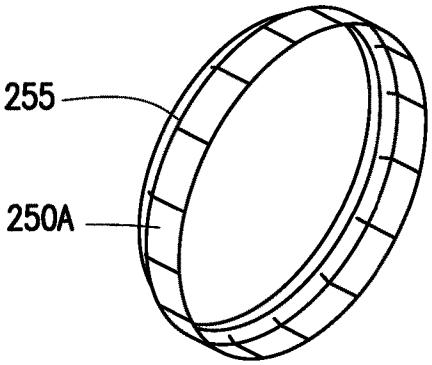
FIGS. 7A-7C illustrate the outer backup ring.
Figure 7B:
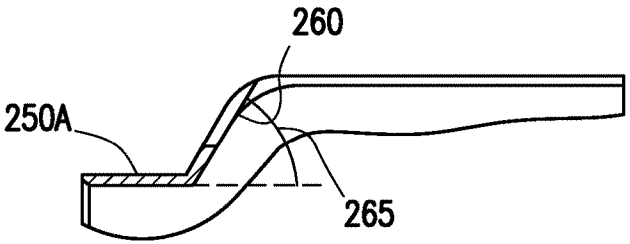
Figure 7A:
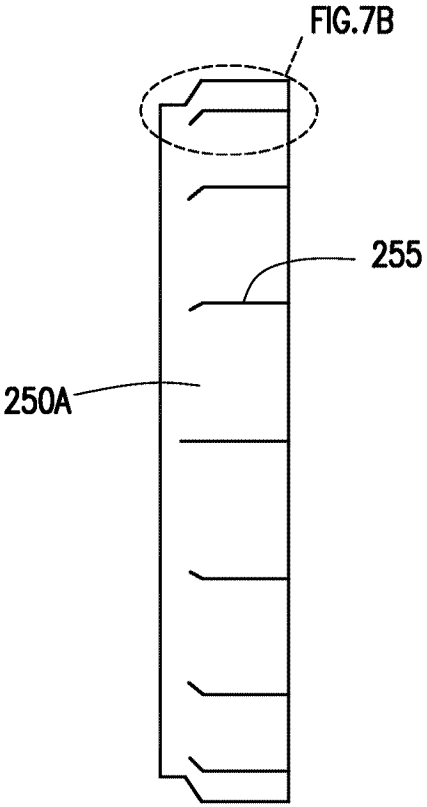
Figure 8C:
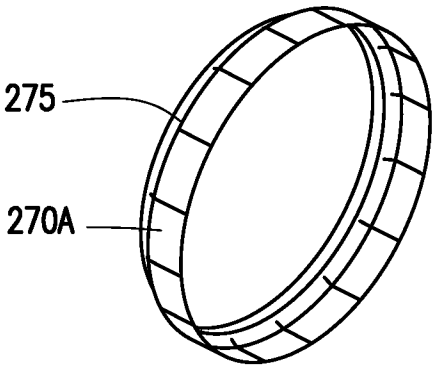
FIGS. 8A-8C illustrate the inner backup ring.
Figure 8B:
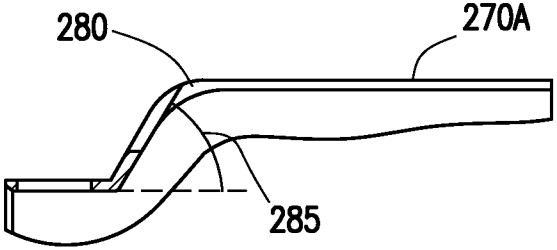
Figure 8A:
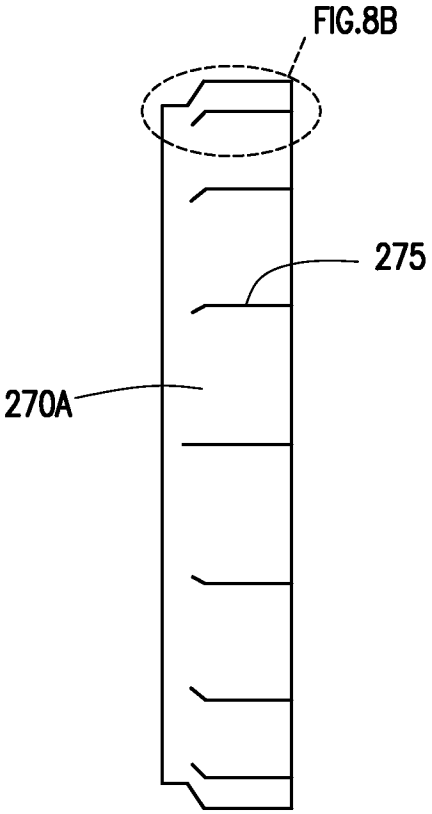

FIGS. 7A-7C illustrate the outer backup ring 250A. FIGS. 8A-8C illustrate the inner backup ring 270A. It is to be understood that the back-up rings 250B, 270B may be mirror images of the back-up rings 250A, 270A. Each back-up ring 250A,B and 270A,B may include a respective shoulder 260, 280 coupling portions of the respective back-up ring having different diameters. The shoulder 280 of the back-up ring 270A has a thickness greater than the shoulder 260 of the back-up ring 250A to allow the back-up ring 270A to withstand the majority of the pressure load from actuation of the cone member 110 during setting of the liner-top packer 100. In addition, the shoulder 260 of the back-up ring 250A has a greater thickness than other portions of the back-up ring 250A, such as the end portions. Likewise, the shoulder 280 of the back-up ring 270A has a greater thickness than the remaining portions of the back-up ring 270A, such as the end portions.

The back-up ring 250A may include an angle 265 at the shoulder 260 thereof, and the back-up ring 270A may include an angle 285 at the shoulder 280 thereof. The angles 265, 285 of the back-up rings 250A, 270A may be selected to facilitate a desired amount of contact between the back-up rings and the inner diameter of the casing 10. In one embodiment, the angles 265, 285 may about 60 degrees. In another embodiment, the angles 265, 285 may be between about 55-65 degrees. In yet another embodiment, the angles 265, 285 may be between about 45-75 degrees. It is contemplated that the angles 265 may or may not be equal. The portions of the back-up ring 250A, 270A having the larger inner diameter (e.g., the unsecured ends of the back-up rings 250A, 270A) may minimize stress concentrations at the corner of the back-up ring 250A, 270A while also reducing the shearing stress under maximum pressure.

Figure 9:
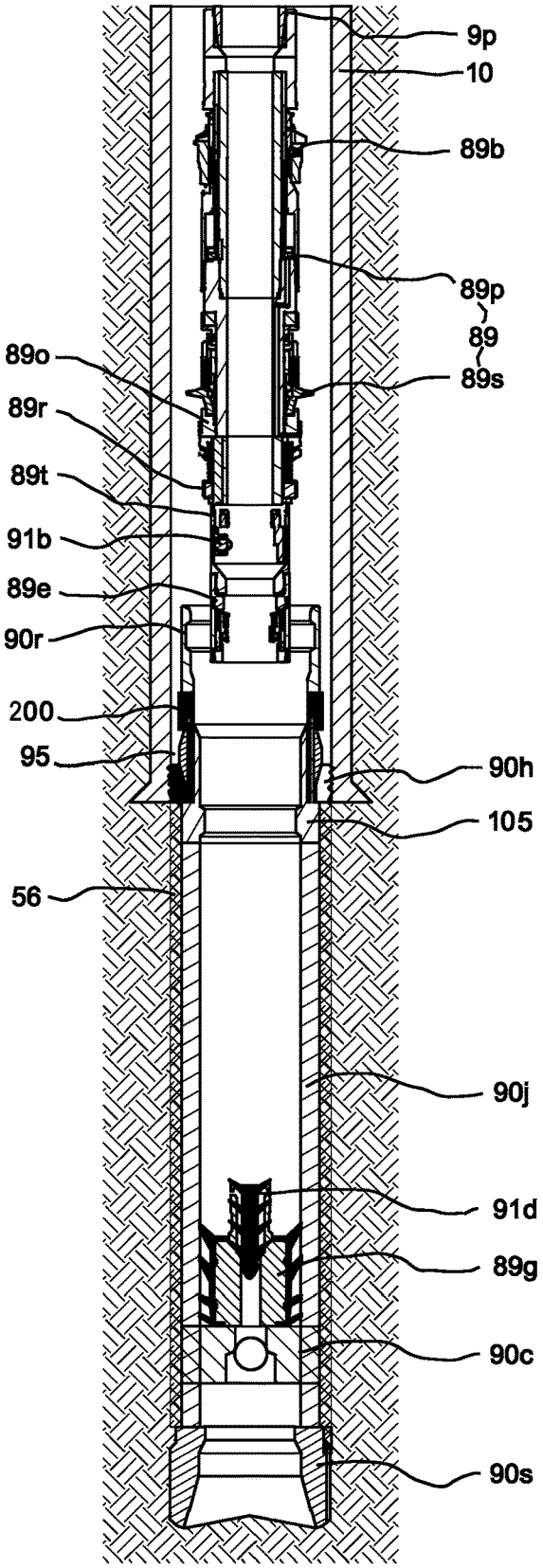
FIG. 9 illustrates a liner string having the liner top packer, according to another embodiment of this disclosure.

FIG. 9 illustrates a liner string 90 having the liner-top packer 100, according to another embodiment of this disclosure. A liner deployment assembly (LDA) 89 may be used to deploy the liner string 90. The liner string 90 may include a polished bore receptacle (PBR) 90*r*, the packer 100 having the element sealing system 200 and the mandrel 105, a liner hanger 90*h* also carried on the mandrel 105, joints of liner 90*j*, a landing collar 90*c*, and a reamer shoe 90*s*. The mandrel 105, liner joints 90*j*, landing collar 90*c*, and reamer shoe 90*s* may be interconnected, such as by threaded couplings. The PBR 90*r* may be connected to the first cone 110, such as by threaded coupling 133 (FIG. 1A).

The LDA 89 may include a setting tool 89*b,o,p,s*, a running tool 89*r*, a catcher 89*t*, and a plug release system 89*e,g*. An upper end of the setting tool 89*b,o,p,s* may be connected to a lower end the drill pipe 9*p*, such as by threaded couplings. A lower end of the setting tool 89*b,o,p,s* may be fastened to an upper end of the running tool 89*r*. The running tool 89*r* may also be releasably connected to the mandrel 105. An upper end of the catcher 89*t* may be connected to a lower end of the running tool 89*r* and a lower end of the catcher may be connected to an upper end of the plug release system 89*e,g*, such as by threaded couplings.

For deployment of the liner string 90, a junk bonnet 89*b* of the setting tool 89*b,o,p,s* may be engaged with and close an upper end of the PBR 90*r*, thereby forming an upper end of a buffer chamber. A lower end of the buffer chamber may be formed by a sealed interface between a packoff 89*o* of the setting tool 89*b,o,p,s* and the PBR 90*r*. The buffer chamber may be filled with a buffer fluid (not shown), such as fresh water, refined/synthetic oil, or other liquid. The buffer chamber may prevent infiltration of debris from the wellbore.

The setting tool 89*b,o,p,s* may include a hydraulic actuator 89*p* for setting the liner hanger 90*h* and a mechanical actuator 89*s* for setting the liner-top packer 100. A cementing head (not shown) may be connected to an upper end of the drill pipe 9*p* for launching a setting plug, such as ball 91*b* and a release plug, such as a dart 91*d*. The ball 91*b* may be pumped down the workstring 9*p*, 89 to the catcher 89*t*. The catcher 89*t* may be a mechanical ball seat including a body and a seat fastened to the body, such as by one or more shearable fasteners. The seat may also be linked to the body by a cam and follower. Once the ball 91*b* is caught, the seat may be released from the body by a threshold pressure exerted on the ball. The threshold pressure may be greater than a pressure required to set the liner hanger 90*h*, unlock the running tool 89*r*, and release the junk bonnet 89*b*. Once the seated ball has been released, the seat and ball 91*b* may swing relative to the body into a capture chamber, thereby reopening the LDA bore.

Once the liner hanger 90*h* has been set and the running tool 89*r* unlocked, the workstring 9*p*, 89 may be rotated, thereby releasing a floating nut of the running tool from a threaded profile 131 (FIG. 1A) of the mandrel 105. The workstring 9*p*, 89 may be raised to verify successful release and lowered to torsionally engage an LDA 89 with a torsional profile 132 (FIG. 1A) of the mandrel 105 for rotation during pumping of the cement slurry 56. The cement slurry 56 may be pumped and followed by the dart 91*d* to release the wiper plug 89*g* from the plug release system 89*e,g*. The wiper plug 89*g* and seated dart 91*d* may be propelled through the liner bore by chaser fluid (not shown) and drive the cement slurry 56 into an annulus 95 formed between the liner string 90 and the wellbore. The LDA 89 may then be lowered until the mechanical actuator 89*s* engages a top of the PBR 90*r* and lowering may continue to set the liner-top packer 100 by actuation of the cone member 110, release of dogs 130 (FIG. 1A), and fracturing of a shearable fastener 135. The first cone member 110 may be actuated axially along the mandrel 105 to compress the element sealing system 200, facilitating expansion thereof, during the setting operation. After the liner-top packer 100 is set, the running tool may be pulled out of the wellbore.

In one embodiment, a sealing system for use in a downhole tool that is disposed in a casing such that a gap is formed between the downhole tool and the casing. The sealing system includes a packing element with a first end and a second end, the packing element having a pre-set cross-sectional thickness that is less than a cross-sectional thickness of the gap formed between the downhole tool and the casing; a first ring member disposed a first end of the packing element; a second ring member disposed at a second end of the packing element; a first seal ring disposed laterally outward of the first ring member; a second seal ring disposed laterally outward of the second ring member; a first inner back-up ring disposed laterally outward of the first seal ring; a first outer back-up ring disposed adjacent the first inner back-up ring; a second inner back-up ring disposed laterally outward of the second seal ring; and a second outer back-up ring disposed adjacent the second inner back-up ring.

In one or more of the embodiments described herein, the packing element is made from an elastomer or elastomeric copolymer, and the seal rings are made from a metal, alloy, or engineering polymer.

In one or more of the embodiments described herein, the first inner back-up ring includes a shoulder having a thickness greater than remaining portions of the first inner back-up ring.

In one or more of the embodiments described herein, the packing element includes a groove formed therein, the groove adjacent a mandrel, and wherein each of the first inner back-up ring and the first outer back-up ring include a shoulder formed therein.

In another embodiment, a method of setting a packer includes positioning a mandrel having a sealing system thereon within a wellbore, and setting the packing element such that the packing element forms a double hump configuration. In one embodiment, the sealing system includes a packing element having a groove formed therein, the groove adjacent the mandrel; a first inner back-up ring disposed at a first end of the packing element, the first inner back-up ring having slots; and a first outer back-up ring having slots, the first outer back-up ring disposed adjacent the first inner back-up ring, wherein that slots in the first outer back-up ring are offset from the slots in the first inner back-up ring; and setting the packing element, wherein setting the packing element includes forming a double hump configuration with the packing element.

In another embodiment, a method of setting a packer in a wellbore includes positioning a mandrel having a sealing element within the wellbore; and setting the packing element such that the packing element forms a double hump configuration.

In one or more of the embodiments described herein, the sealing element is positioned at a distance from the wellbore bore that is more than a thickness of the sealing element.

In one or more of the embodiments described herein, a ratio of the distance between the sealing element and the wellbore wall to the thickness of the sealing element is from about 1.05 to about 2.0.

In another embodiment, a liner string includes a mandrel having a profile formed in an inner surface thereof for releasable connection to a running tool; the sealing system according to an embodiment described herein, the sealing system disposed along the mandrel; a liner hanger disposed along the mandrel; and a polished bore receptacle connected to a first cone member of the sealing system.

While the foregoing is directed to embodiments of the present disclosure, other and further embodiments of the disclosure may be devised without departing from the basic scope thereof, and the scope of the invention is determined by the claims that follow.

What is claimed is:

1. A sealing system for use in a downhole tool, the sealing system comprising:

a packing element including a groove in a surface thereof, the packing element adapted to form a double hump configuration upon compression and adapted to seal a gap between a casing string and the packing element in an uncompressed configuration that is greater than a cross sectional thickness of the packing element, wherein a ratio of the cross-sectional thickness of the gap to the pre-set cross-sectional thickness of the sealing element is from about 1.05 to about 2.0;

a first ring member disposed on a mandrel and at a first end of the packing element;

a second ring member disposed on the mandrel and at a second end of the packing element, wherein the first ring member and the second ring member each comprise a laterally outward surface disposed at an angle between 5 degrees to 20 degrees relative to perpendicular to the mandrel, the laterally outward surface of each of the first ring member and the second ring member extending from the mandrel to a respective radially-outward end of the first ring member and the second ring member;

a first seal ring disposed laterally outward of the first ring member, wherein the laterally outward surface of the first ring member is adjacent the first seal ring;

a second seal ring disposed laterally outward of the second ring member, wherein the laterally outward surface of the second ring member is adjacent the second seal ring;

a first inner back-up ring disposed laterally outward of the first seal ring, the first inner back-up ring having slots; and a first outer back-up ring having slots, the first outer back-up ring disposed adjacent the first inner back-up ring, wherein the slots in the first outer back-up ring are offset from the slots in the first inner back-up ring.

2. The sealing system of claim 1, further comprising:

a second inner back-up ring disposed laterally outward of the second seal ring, the second inner back-up ring having slots; and a second outer back-up ring having slots, the second outer back-up ring disposed adjacent the second inner back-up ring, wherein the slots in the second outer back-up ring are offset from the slots in the second inner back-up ring.

3. The sealing system of claim 2, further comprising:

a fastener coupling the first inner back-up ring to the first outer back-up ring to prevent rotational movement therebetween.

4. The sealing system of claim 2, wherein the slots in each of the first inner back-up ring, the second inner back-up ring, the first outer back-up ring, and the second outer back-up ring are disposed circumferentially therearound.

5. The sealing system of claim 2, wherein the first inner back-up ring and the second inner back-up ring include shoulders disposed therearound, and wherein the shoulder of the first inner back-up ring has a first thickness greater than a thickness of the remaining portions of the first inner back-up ring.

6. The sealing system of claim 2, further comprising:

a first cone member coupled to the first inner back-up ring and the first outer back-up ring by a first shearable fastener; and a second cone member coupled to the second inner back-up ring and the second outer back-up ring by a second shearable fastener.

7. A liner string, comprising:

the sealing system of claim 6 disposed along the mandrel, the mandrel having a profile formed in an inner surface thereof for releasable connection to a running tool;

a liner hanger disposed along the mandrel; and a polished bore receptacle connected to the first cone member.

8. A method of hanging a liner string of claim 7 from a tubular string cemented in a wellbore, comprising:

running the liner string into a wellbore using a workstring having a deployment assembly, wherein the deployment assembly comprises a setting tool, a running tool, a catcher, and a plug release system:

setting the liner hanger against the tubular string by pumping a setting plug to the catcher;

after setting the hanger, releasing the running tool from the mandrel;

after releasing the running tool, pumping cement slurry through the workstring followed by a release plug, wherein the release plug engages a wiper plug of the plug release system and drives the cement slurry through the liner string and into an annulus formed between the liner string and the wellbore; and raising the deployment assembly and setting weight on the polished bore receptacle using the setting tool, thereby:

radially expanding a packing element and sealing a gap formed between the sealing system and the tubular string, wherein radially expanding the packing element results in the packing element forming a double hump configuration, and wherein a distance of the gap is greater than a cross sectional thickness of the packing element; and radially expanding the back-up rings into contact with the tubular string.

9. The method of claim 8 wherein:

the groove in the packing element causes upper and lower sections of the packing element to expand into the gap.

10. The sealing system of claim 2, wherein the first outer backup ring and the second outer back up ring are configured to contact the casing upon compression.

11. The sealing system of claim 2, wherein the first inner backup ring, the second inner backup ring, the first outer backup ring, and the second outer backup ring each include a shoulder, wherein the shoulder of the first inner backup ring has a thickness greater than the shoulder of the first outer backup ring, and wherein the shoulder of the second inner backup ring has a thickness greater than the shoulder of the second outer backup ring.

12. The sealing system of claim 2, wherein the first inner backup ring, the second inner backup ring, the first outer backup ring, and the second outer backup ring each include a shoulder, and wherein the shoulder of the first inner backup ring has a thickness greater than remaining portions of the first inner backup ring, and wherein the shoulder of the first outer backup ring has a thickness greater than remaining portions of the first outer backup ring.

13. The sealing system of claim 12, wherein the shoulder of the second inner backup ring has a thickness greater than remaining portions of the second inner backup ring, and wherein the shoulder of the first outer backup ring has a thickness greater than remaining portions of the first outer backup ring.

14. The sealing system of claim 1, wherein the first inner back-up ring extends axially towards the packing element further than the first outer back-up ring.

15. The sealing system of claim 1, wherein the packing element has a lower durometer than the first seal ring and the second seal ring.

16. The sealing system of claim 1, wherein the first outer backup ring is configured to contact the casing upon compression.

17. The sealing system of claim 1, wherein the first ring member is spaced from both the first inner back-up ring and the first outer back-up ring when the packign element is in an uncopmressed configuration, and the second ring member is spaced from both the second inner back-up ring and the second outer back-up ring when the packign element is in an uncopmressed configuration.

18. A sealing system for use in a downhole tool, the downhole tool being disposed in a casing such that a gap is formed between the downhole tool and the casing, the sealing system comprising:

a packing element with a first end and a second end, the packing element disposed on a mandrel and having a pre-set cross-sectional thickness that is less than a cross-sectional thickness of the gap formed between the downhole tool and the casing, wherein a ratio of the cross-sectional thickness of the gap to the pre-set cross-sectional thickness of the sealing element is from about 1.05 to about 2.0;

a first ring member disposed on the mandrel and at a first end of the packing element;

a second ring member disposed on the mandrel and at a second end of the packing element, wherein the first ring member and the second ring member each comprise a laterally outward surface disposed at an angle between 5 degrees to 20 degrees relative to perpendicular to the mandrel, the laterally outward surface of each of the first ring member and the second ring member extending from the mandrel to a respective radially-outward end of the first ring member and the second ring member;

a first seal ring disposed laterally outward of the first ring member;

a second seal ring disposed laterally outward of the second ring member;

a first inner back-up ring disposed laterally outward of the first seal ring;

a first outer back-up ring disposed adjacent the first inner back-up ring;

a second inner back-up ring disposed laterally outward of the second seal ring; and a second outer back-up ring disposed adjacent the second inner back-up ring.

19. The sealing system of claim 18, wherein the first outer back-up ring and the first inner back-up ring include a plurality of slots formed therein.

20. The sealing system of claim 19, wherein the first inner back-up ring and the first outer back-up ring include mating contoured surfaces.

21. The sealing system of claim 20, wherein the second inner back-up ring and the second outer back-up ring include mating contoured surfaces.

22. The sealing system of claim 18, wherein the first inner back-up ring extends axially towards the packing element further than the first outer back-up ring, and the second inner back-up ring extends axially towards the packing element further than the second outer back-up ring.

23. The sealing system of claim 19, further comprising a fastener coupling the first inner back-up ring to the first outer back-up ring to prevent rotational movement therebetween.

24. A liner string, comprising:

the sealing system of claim 18 disposed along the mandrel, the mandrel having a profile formed in an inner surface thereof for releasable connection to a running tool;

a liner hanger disposed along the mandrel; and a polished bore receptacle connected to a first cone member of the sealing system.

25. A method of setting a packer in a wellbore, comprising:

positioning the packer in the wellbore, the packer including:

a mandrel;

a packing element within the wellbore, a first ring member disposed on the mandrel and at a first end of the packing element;

a second ring member disposed on the mandrel and at a second end of the packing element, a first seal ring disposed laterally outward of the first ring member;

a second seal ring disposed laterally outward of the second ring member;

a first inner back-up ring disposed laterally outward of the first seal ring; and a first outer back-up ring, disposed adjacent the first inner back-up ring;

wherein positioning the packer comprises positioning the packing element at a distance from the wellbore bore that is more than a thickness of the packing element, wherein a ratio of the distance to the thickness of the packing element is from about 1.05 to about 2.0, the sealing packing element disposed between the first ring member and the second ring member, wherein the first ring member and the second ring member each comprise a laterally outward surface disposed at an angle between 5 degrees to 20 degrees relative to perpendicular to the mandrel, the laterally outward surface of each of the first ring member and the second ring member extending from the mandrel to a respective radially-outward end of the first ring member and the second ring member, and wherein the laterally outward surface of the first ring member is adjacent to the first seal ring and the laterally outward surface of the second ring member is adjacent to the second seal member; and setting the packing element such that the packing element forms a double hump configuration.

* * * * *